US006102550A

United States Patent [19]

Edwards, Jr.

[11] Patent Number: 6,102,550

[45] Date of Patent: Aug. 15, 2000

[54] BRACKET ASSEMBLY FOR FLUORESCENT LIGHTING FIXTURE HAVING REMOVABLE, HIGH-FREQUENCY POWER OUTPUT BALLAST

[75] Inventor: Richard D. Edwards, Jr., Warwick, R.I.

[73] Assignee: Photronix, LLC, Warwick, R.I.

[21] Appl. No.: 09/251,013

[22] Filed: Feb. 16, 1999

[51] Int. Cl.[7] ..... F21V 23/02

[52] U.S. Cl. ..... 362/221; 362/222; 362/217; 362/265; 362/260

[58] Field of Search ..... 362/221, 222, 362/217, 265, 260

[56] References Cited

U.S. PATENT DOCUMENTS

| | | | |
|---|---|---|---|
| 4,674,015 | 6/1987 | Smith | 362/217 |
| 5,207,504 | 5/1993 | Swift et al. | 362/260 |

*Primary Examiner*—Sandra O'Shea
*Assistant Examiner*—Ronald E. DelGizzi
*Attorney, Agent, or Firm*—Cesari and McKenna, LLP

[57] ABSTRACT

A bracket system for fluorescent lighting fixtures using tubular bulbs and a ballast assembly for mounting on such brackets is provided. Each of a pair of opposing brackets includes a main bracket section and at least two bulb-mounting/connecting ends that receive tubular fluorescent light bulbs therein and that electrically connect the light bulbs with the ballast-generated, high-frequency driving current. The ballast housing is adapted for quick-connection to and disconnection from the main bracket section. Contact pads are provided to each of the main bracket section and the ballast housing. Conventional AC power is received through some of the contact pads for input to the ballast, and high-frequency driving current is transmitted from the ballast back to other contact pads for distribution to the underlying bracket bulb-mounting/connecting ends and to those of the opposing bracket. The bulb-mounting/connecting ends can be mounted slidably on the main bracket section and can also pivot relative to the main bracket section for maximum adjustability.

13 Claims, 15 Drawing Sheets

BRACKET ASSEMBLY FOR FLUORESCENT LIGHTING FIXTURE HAVING REMOVABLE, HIGH-FREQUENCY POWER OUTPUT BALLAST

FIELD OF INVENTION

This invention relates to fluorescent lighting systems and more particularly to fluorescent light bulb brackets and ballasts for powering such light bulbs.

BACKGROUND OF THE INVENTION

Fluorescent lighting fixtures are available in a variety of shapes and sizes. One popular fixture is, in essence, a box having a width of approximately two feet and a length of approximately four feet. This box is designed to be mounted in a drop ceiling used, for example, in offices and industrial spaces. The box encloses three to four elongated tubular fluorescent bulbs according to the prior art. Applicant's co-pending U.S. patent application entitled Fluorescent Light Fixture, Ser. No. 09/048,554, filed Mar. 26, 1998 (the "'554 application" herein), describes a modified fixture enclosure box and reflector arrangement that preferably enables two conventional bulbs to be mounted in a fixture. The teachings of this patent application are expressly incorporated herein by reference. The fixture box described in the '554 application is modified to increase optical performance while reducing physical profile. Nevertheless, this box includes a conventional ballast positioned, typically, under a portion of the reflector. The ballast is an electronic component needed to convert standard AC line voltage (typically 110 or 220 VAC at 50–60 Hz) to high frequency driving current for operating fluorescent bulbs. It is usually contained in a sealed metal housing with lead wires for both feed and output current. To install and periodically replace such prior art ballasts requires the services of a licensed electrician in most instances. This is because the fixture must be partially dismantled. In such disassembly, the bulbs and reflector are first removed to reveal the ballast. Sometimes the entire fixture must be lowered from the ceiling when the ballast is located outside the box itself. Once the ballast unit is accessed, it is unscrewed from the sheet metal box and the wires are carefully disconnected from the fixture's power feeds and from the leads that connect the mounting brackets to each fluorescent light bulb. Clearly this process is time consuming and costly.

In addition, most connecting brackets are individually mounted to the inside end wall of the fixture box. Their position is carefully preset, and not subject to substantially variability. There may be various obstructions along the end walls of the box that limit movement of the brackets to other locations. This limits the ability to optimize bulb placement or increase or decrease the number of bulbs in a given fixture. Since energy conservation is an increasing concern, such modification of existing fixtures is often highly desirable.

It is therefore an object of this invention to provide a fluorescent bulb bracket and ballast system that allows easy connection and disconnection of the ballast with respect to the light fixture. Such connection and disconnection should not require substantial dismantling of the light fixture. In addition, it is desirable that the light fixture bulb mounting/connecting brackets allow versatile adjustment and that the a single ballast in the system be usable to drive a group in a of ganged fixtures.

SUMMARY OF THE INVENTION

This invention overcomes the disadvantages of the prior art by providing a fluorescent light bulb-mounting/connecting bracket for a multi-bulb fixture enclosure box having on-board mounting locations for a removable, self-contained ballast. The bracket includes a plurality of individual connector pads that interconnect respect source power feeds and outputs to individual bulb connectors on the bracket. Additional connection pads are also provided on the bracket, typically as sockets or plugs, to transfer power from the ballast to the bulb-mounting/connecting ends of an opposing bracket, and optionally, to remote, ganged fluorescent light fixtures (when such fixtures are to be driven by the same ballast.

The ballast and associated bracket can include interlocking connectors to enable rapid/quick connection and disconnection of the ballast from the bracket. In general, the ballast and bracket are shaped to allow clearance for bulbs, reflector components and obstructions normally found within prior art and modified fluorescent light fixture boxes, but that enable the ballast to be accessed for service/removal/installation through the lower opening of the fixture box with minimal disassembly of fixture components. In a preferred orientation, the ballast is located beneath a ledge of the box's lower cover such that is not generally visible by an observer.

A fluorescent bulb mounting/connecting bracket according to this invention can further include fluorescent light fixture bracket ends, with associated bulb mounts/connectors, that are moveable toward and away from each other and that also pivot within a predetermined arc. Appropriate contacts are provided within the bracket that enable the ends to remain electrically connected to the ballast, via a central main bracket section, as they are moved throughout a range of movements. By providing movable brackets, the location and focus of each of the fluorescent light fixture bulbs in the box can be optimized.

According to a preferred embodiment, the fluorescent light fixture brackets include mounting dogs that enable the brackets to be mounted, in a retrofit arrangement to the end walls of a conventional fluorescent fixture enclosure box. The ends are constructed so that, generally, they lay flushly against the ends walls of a conventional box, while the central section of the bracket, which can include the ballast mounted thereon, is typically suspended away from the end wall, thus circumventing any obstructions that occur at the end wall. This is accomplished by providing bridging sections to the end that angle away from the end wall, toward the center of the box. Alternatively, the bracket main section, or ends can be mounted to the top wall of the fixture box. Mounting brackets and corresponding spacer feet can be provided to locate the bulbs/brackets at the proper height within the box. The brackets can include mounts for the reflector. The mounts can be placed on the bracket ends so that, when the ends are moved to adjust bulb placement, the reflector flexes to follow the movement and remain substantially aligned with the bulbs.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
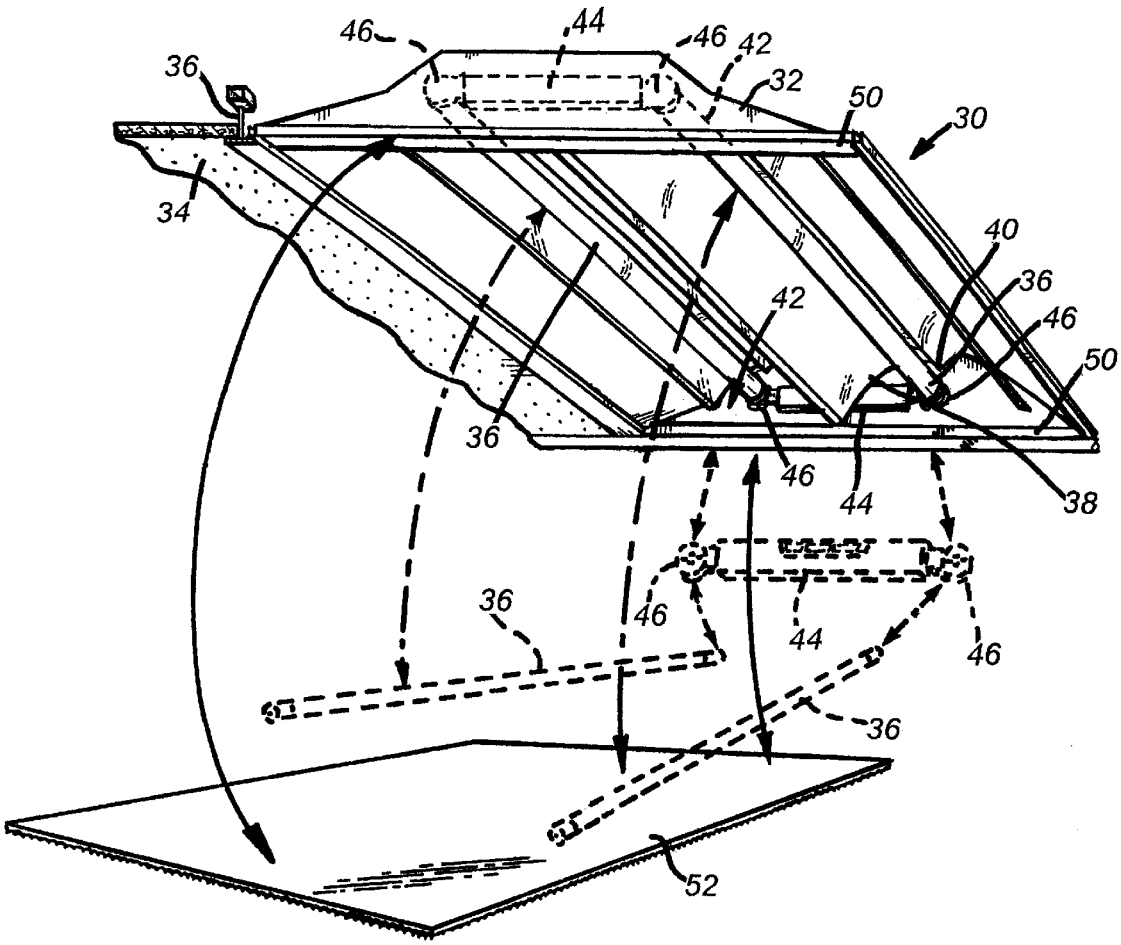
FIG. 1 is an exploded perspective view of a fluorescent light fixture bracket system according to an embodiment of this invention.

A fluorescent light fixture assembly arranged according to an embodiment of this invention is detailed in FIG. 1. The fixture 30 includes an enclosure box 32. In this example, the enclosure box 32 has a shape similar that described in applicant's co-pending '554 application noted above. Alternatively, the box can be a typically conventional design that is substantially rectangular. The fixture of this embodiment is adapted to be mounted in a "drop ceiling" in which it is surrounded by acoustic tiles 34 that are suspended by T-shaped hangers 37 from an overlying structural ceiling (not shown). The hangers 37 are manipulated to allow tiles and fixture boxes to be inserted in the ceiling, and then are moved in place to support the tiles and fixture boxes against downward movement. Supplemental support cables and brackets can also be provided between the structural ceiling and boxes.

It should be noted that the principles described herein are applicable to a variety of different types and shapes of fixture boxes. For example, it is expressly contemplated that the principles to be described herein are applicable to flush-mount fixture boxes secured directly to a ceiling surface and projecting below the surface. In addition, the principles described herein are applicable both to new-manufacture fixtures and to existing fixture boxes that are to be provided with so-called retrofit bulb brackets and reflectors. Such retrofit arrangements are increasingly popular as they enable existing boxes to be recycled, in Situ so that lighting efficiently and power consumption can be increased without completely replacing the fixture unit.

The fixture design according to the above-referenced '554 patent application enables the effective use of only two fluorescent bulbs 36 of conventional design and output. A specially designed reflector 38 is provided with a pair of curved surfaces that join at a central peak or ridge 40 located in alignment with each bulb. Again, this reflector is described in detail in the above-referenced patent application. With reference particularly to FIG. 1, a modified bulb mounting/connecting bracket assembly, according to this invention is provided adjacent each end wall 42 of the housing 32. The bracket assembly 44 includes bulb mounting ends 46 that receive a respective end of a fluorescent bulb 36. Appropriate conventional bulb mounts/electrical connectors, to be described below, are provided at the respective bracket ends 46. These connectors typically define a pair of spring-loaded sockets for interconnecting to a pair of bulb connector pins. In general, the brackets 44 are obscured by a lower ledge 50 adjacent each end wall 42 of the housing on the open side of the fixture box. A translucent cover 52 is used to enclose the exposed opening of the housing 42 in this example. This cover 52 can comprise glass or a polymer with a variety of diffuser structures placed thereon that are well-known. Alternatively, the translucent cover 52 can be omitted, or substituted with gratings or similar structures. Note that the bracket, and others described herein can be constructed from metal, plastic/polymer, glass-filled resin, or another suitable material. The brackets can be internally grounded (in the case of metal) or can include various ground wires. Such grounds can be attached to an underlying grounded fixture box, or directly to a separate AC power line-supplied ground wire/plane.

Figure 2:
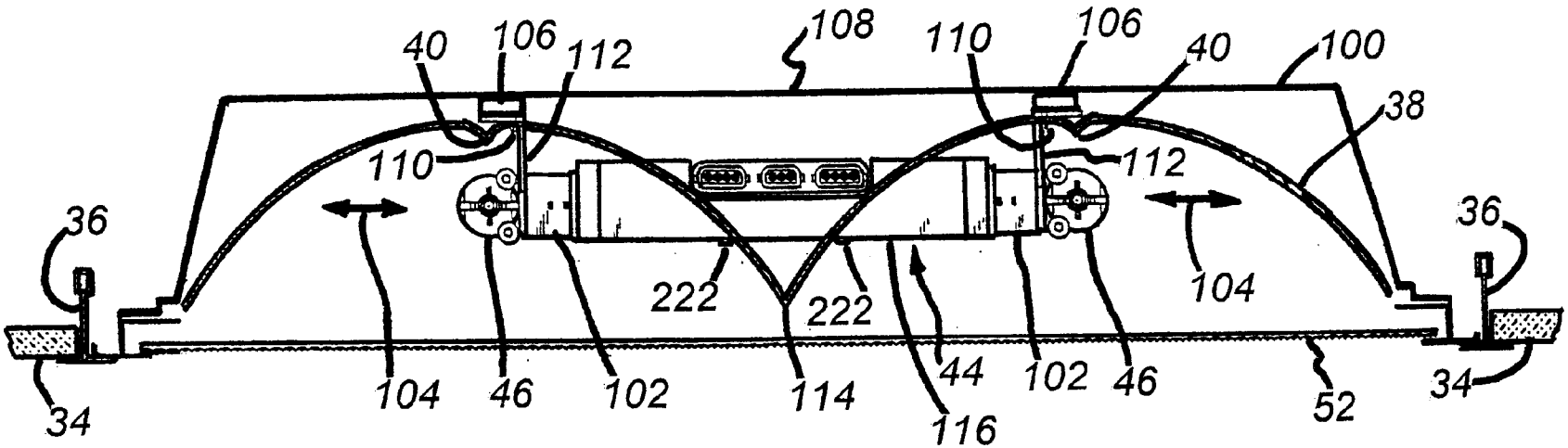
FIG. 2 is a side cross section of a fluorescent light fixture bracket in a retrofit arrangement according to an embodiment of this invention.

With further reference to FIG. 2, a more-conventional housing 100 is shown. The modified reflector 38 having central ridges 40 is detailed further. The bracket 44 is also shown in greater detail. The bracket's bulb mount/connector ends 46, in this embodiment, are each mounted on movable base 102 that enable the ends 46 to move linearly toward and away from each other (double arrows 104) for optimum adjustment of the light profile. Typically, such adjustment occurs before final mounting of the bracket into the enclosure. In this embodiment, mounting bracket feet 106 are secured to the top wall 108 of the enclosure 100. Screws, rivets or other fastening mechanisms can be used to secure the feet 106 in place. According to this embodiment, a rivet or expanding clip 110 secures the mounting brackets 112 to the reflector 38. In a preferred embodiment, the reflector is constructed from a somewhat flexible material such as thin-gauge chromed/polished steel, polished aluminum, or a metalized plastic. Hence, the reflector can be expanded and contracted about its main ridge 114 to enable each well of the reflector to be centered about each respective bulb regardless of the position of each end with respect to the central portion of the bracket.

Figure 3:
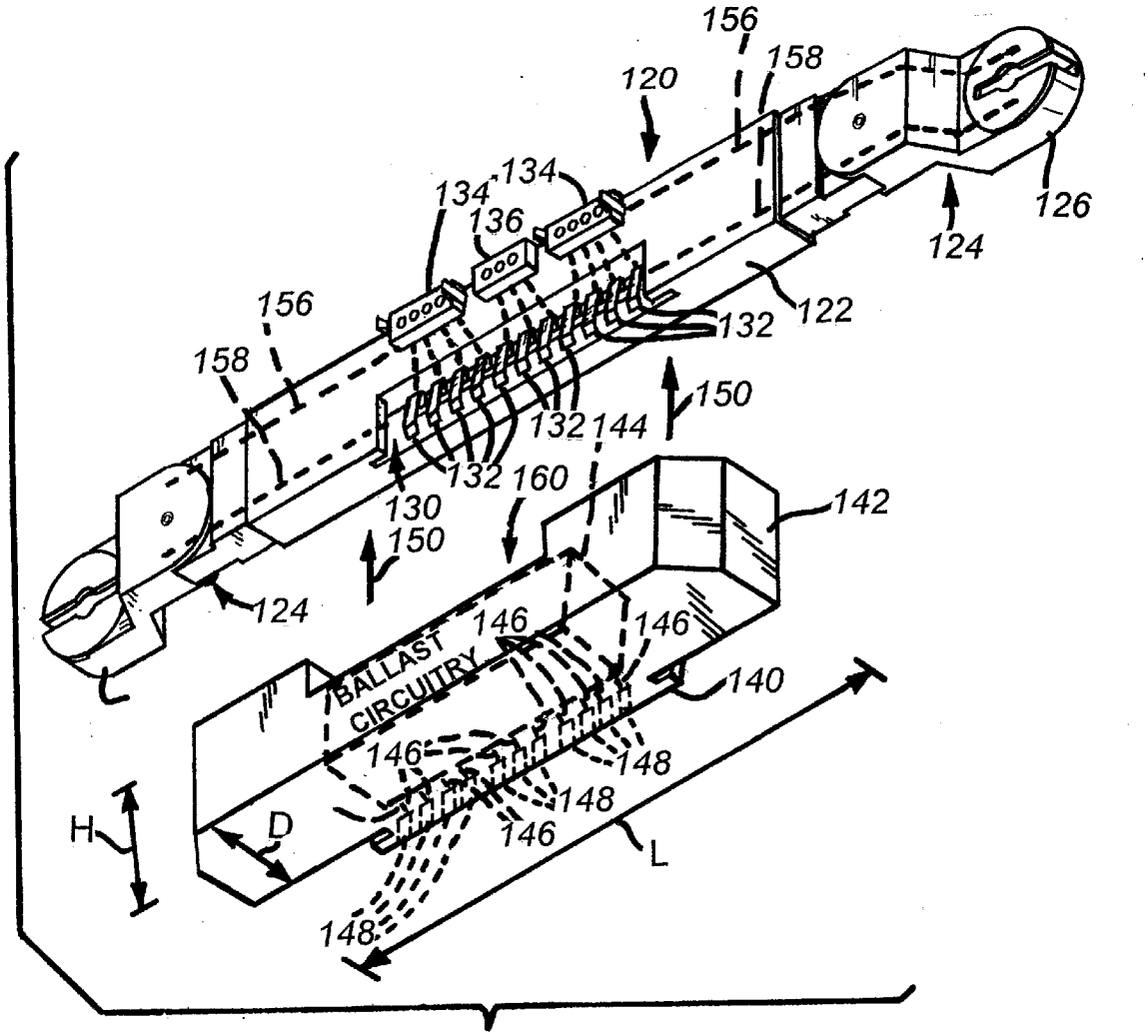
FIG. 3 is an exploded perspective view of a bracket with a quick-disconnect ballast unit for use in the system of FIG. 2.
Figure 4:
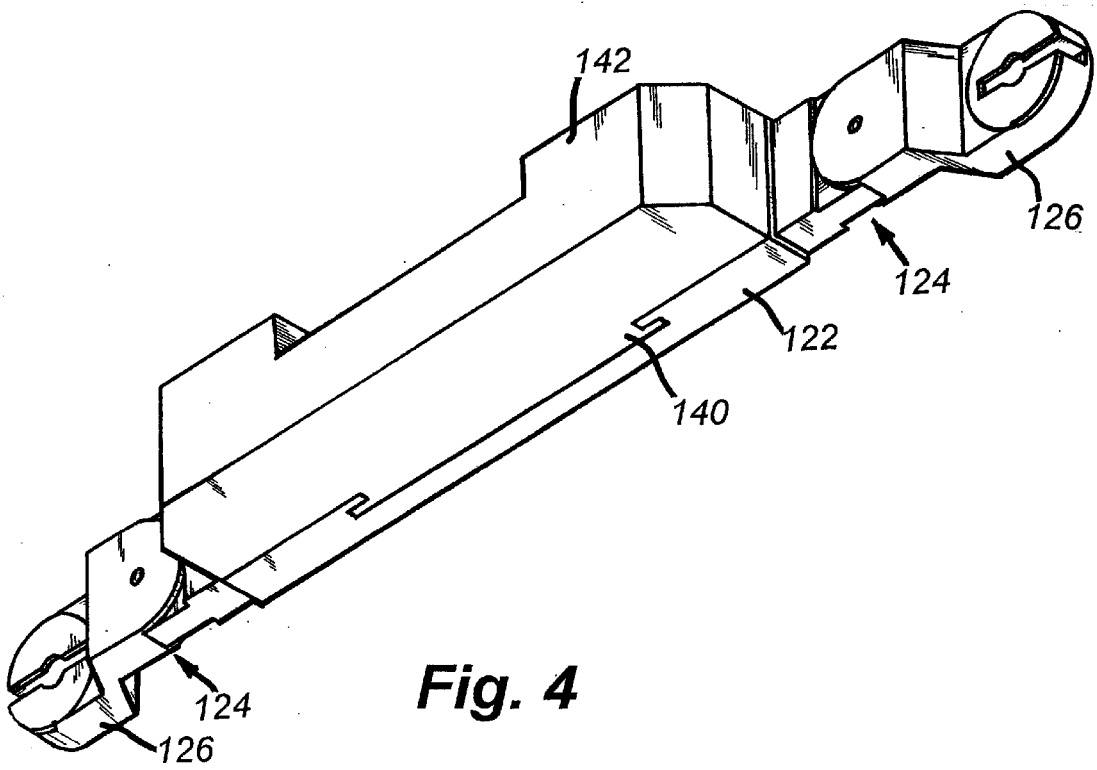
FIG. 4 is a perspective view of the assembled bracket and ballast of FIG. 3.

An unmounted bracket 120, according to a preferred embodiment of this invention is shown in further detail in FIGS. 3–4. This bracket 120 includes a central section 122 and a pair of opposing ends 124. Each of the ends 124 includes a mount/connector 126 for receiving the two-pin electrical end connector of a conventional fluorescent bulb. As noted above, the ends 124 can be moved toward and away from each other—and with respect to the bracket's central section 122. This will be described in further detail below. The central section 122 includes a T-shaped slot 130. Within the T-shaped slot are located a series of spring-loaded connector 132. Each of these connectors 132 are electrically connected to respective pins or sockets on a series of three corresponding sockets 134 and 136. The connectors are shown generally in phantom. According to this embodiment, the T-shaped slot 130 receives a corresponding T-shaped connector 140 formed in a ballast housing 142 of this invention. The ballast housing 142 can be constructed from metal or polymer as a one-piece unit, or as a two-piece unit that is screwed/glued or welded together. Within the ballast housing is enclosed a conventional fluorescent lighting ballast circuitry 144 (shown in phantom) according to any acceptable design. It is recognized that currently-available ballast circuitry includes electronics that are sufficiently compact so as to be self-contained in a ballast housing having a height H of approximately 1–2 inches (preferably 1⅜ inches) length L of approximately 4–8 inches (preferably 7¼ inches) and a depth D of approximately ½–2 inches (preferably ¾ inch). Such a ballast circuitry is available from major lighting and electronic component suppliers such as Energy Savings, Inc., Magnatech, Osram-Sylvania and/or Motorola, among others. By way of example, an acceptable electronic ballast for the applications described herein is model ES-2-T8-32-120-A from Energy Savings, Inc. of Schaumburg, Ill., adapted to power a pair of T8 32-Watt flourescent bulbs. In general, the electronic ballasts commercially available from these and other sources have been further miniturized in recent years, making them increasingly suitable to the application described herein. The ballast circuitry 144 includes appropriate wiring 146 interconnecting with associated contact pads 148. The contact pads 148, in this embodiment are fixed, while the bracket contacts 132 are movable under internal spring force to maintain electrical contact with the ballast. Clearly, this relationship of fixed-to-movable contacts can be reversed or mixed. In general, by inserting the ballast's T-shaped connector 140 into the T-shaped slot 130 as shown by the arrows 150, the ballast circuitry is placed into electrical interconnection with the bracket contacts. The interconnected bracket and ballast is shown particularly in FIG. 4. The precise wiring of the bracket contacts 132 can be varied. In one embodiment, raw power in the form of 120 Volt/60 Hz AC current, is provided to the socket 136 from a switched source. There are two main leads and a ground wire. The ballast converts the raw AC line power into a characteristic high-frequency driving current sufficient for operating fluorescent light bulbs. This resulting high-frequency driving current is out put at the sockets 134. Appropriate internal connections (shown as phantom wires 156 and 158) also connect the sockets to the bracket's bulb end mounts/connectors 126. Typically, the opposing brackets ends are energized via remote wires interconnected between the socket connector and the ends. This is described further with reference to FIG. 9 below.

In general, a well 160 is provided within the central portion of the ballast housing 142 to provide clearance for the sockets 134 and 136. An alternate embodiments, the shape and size of the housing can be altered, and the position of the sockets can be altered to alleviate the need for such a well.

While not shown, it can be assumed that the opposing bracket in the housing can be of similar design to the bracket 122. In other words, it generally can include the sockets 134 and 136 and even the T-shaped slot 130. Conversely, a bracket without a dedicated T-shaped slot can be provided in order to save costs. In both instances, the specific sockets 134 can be used to route high-frequency driving current to the respective bulb mounting ends alternatively, a simplified electrical connection can also be provided.

Note that the T-slot used to secure the ballast housing 142 to the bracket 122 can be modified to any acceptable secure interconnection. A slot of this shape is used because it allows quick, slidable attachment of the ballast housing onto the bracket from a position beneath the bracket (e.g. through the opening in the fixture housing). For example, in an alternate embodiment a hinged ballast-to-bracket attachment can be used. A direct overlaying pinned attachment can also be used. One or more smaller slide tracks can be employed instead of a T-shaped slot. The ballast can be provided with plug pins or plug sockets that are passed directly onto corresponding plug sockets or pins (respectively) on the bracket. Or the ballast can be screwed/fastened directly onto the ballast to bring overlying connectors into facing contact. According to an alternate embodiment, the housing can be provided with an appropriate cover that enables the ballast circuitry 144 to be removed without removing the entire housing. In addition, it is expressly contemplated that the bracket can be provided with a fixed housing having for example, a hinged cover from which the ballast circuitry is removed. All of these structures shall be considered a bracket-mounted removable ballast assembly according to this invention.

Figure 5:
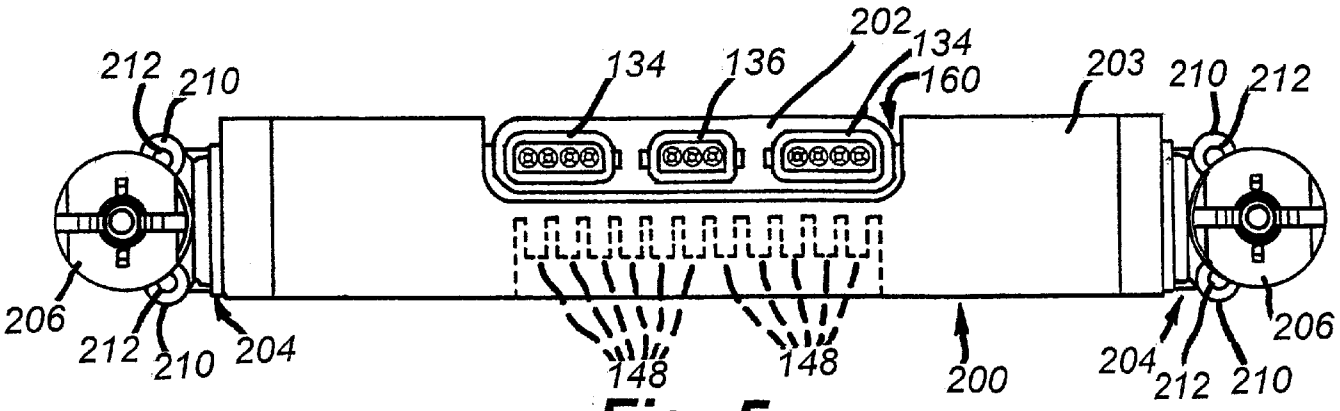
FIG. 5 is a partially exposed side view of the bracket and ballast FIG. 3.
Figure 6:
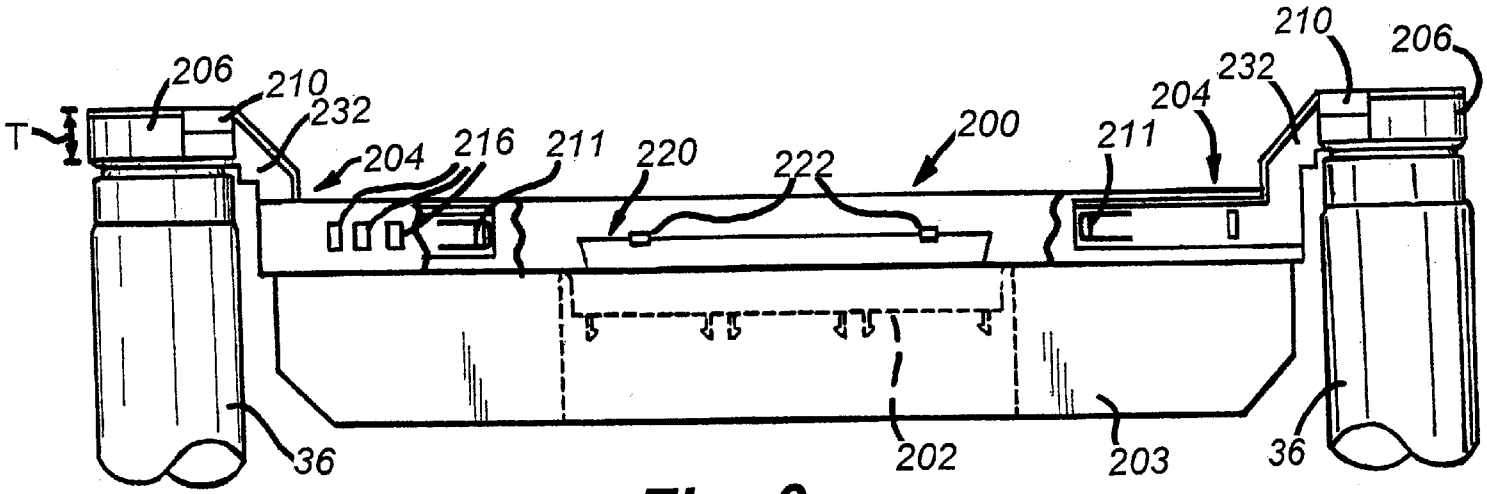
FIG. 6 is a partially exposed plan view of the bracket and ballast of FIG. 3.

FIGS. 5 and 6 show a slightly modified bracket according to another embodiment of this invention. This bracket corresponds closely to that shown in FIGS. 1 and 2. Elements similar to those described above for FIGS. 3 and 4. Shall be given like reference numbers. The sockets 134 and 136 are mounted on a raised base 202 in this embodiment. Either a raised of flush base can be used. The well 160 in the ballast housing 203 is maintained to allow clearance for the base 202. Again, a pair of sliding ends 204 are provided to opposing ends of the main bracket section 200. A pair of associated bulb mounting ends 206 are located on the ends 204. In this embodiment, the ends include mounting dogs 210 with centered holes 212. As shown in further detail in FIG. 7, the holes receive screws 214. In this embodiment, the screws are heat metal screws that pass through-perforations in the end wall 220 of the fixture housing enclosure. As noted above, the exact spacing of the mounting ends 206 and hence, the bulbs 36 can be varied by moving the ends 204 with respect to the central bracket section 200. A spring-loaded shoulder 211 can be provided to the inner portion of each end 204. The ends ride within the hollow ends of the central bracket section 200. The shoulder 211 bares upon each of a series of rectangular slots 216. The slots 216 are provided at even intervals. In this embodiment, the intervals can be approximately ¼–½ inch apart, more or less. Any appropriate spacing can be used however. The spring force of the shoulder 211 enables it engage each of the slots to prevent free slidable movement of the respective end 204 relative to the central bracket section 200. The locations of the shoulders 211 and slots 216 can be at any point along the perimeter of the essential bracket. By applying appropriate pressure, the locking force of the shoulder can be overcome, and the associated bracket end 204 can be moved to another position. In some embodiments, slots can be omitted to enable freely variable movement of ends relative to the central bracket section. Conversely, according to alternate embodiments, the bracket ends can be permanently fixed in particular positions with respect to the central bracket section. In each of these embodiments, the mounting dogs 210 enable the bracket to be fixed to the end wall of a new or old-work fixture enclosure box. The use of such dogs, in combination with the removable ballast of this invention, advantageously results in the use of only four fasteners (at most) and three external AC power wire connections to install an entirely new lighting bracket arrangement in an existing fixture box enclosure.

Figure 7:
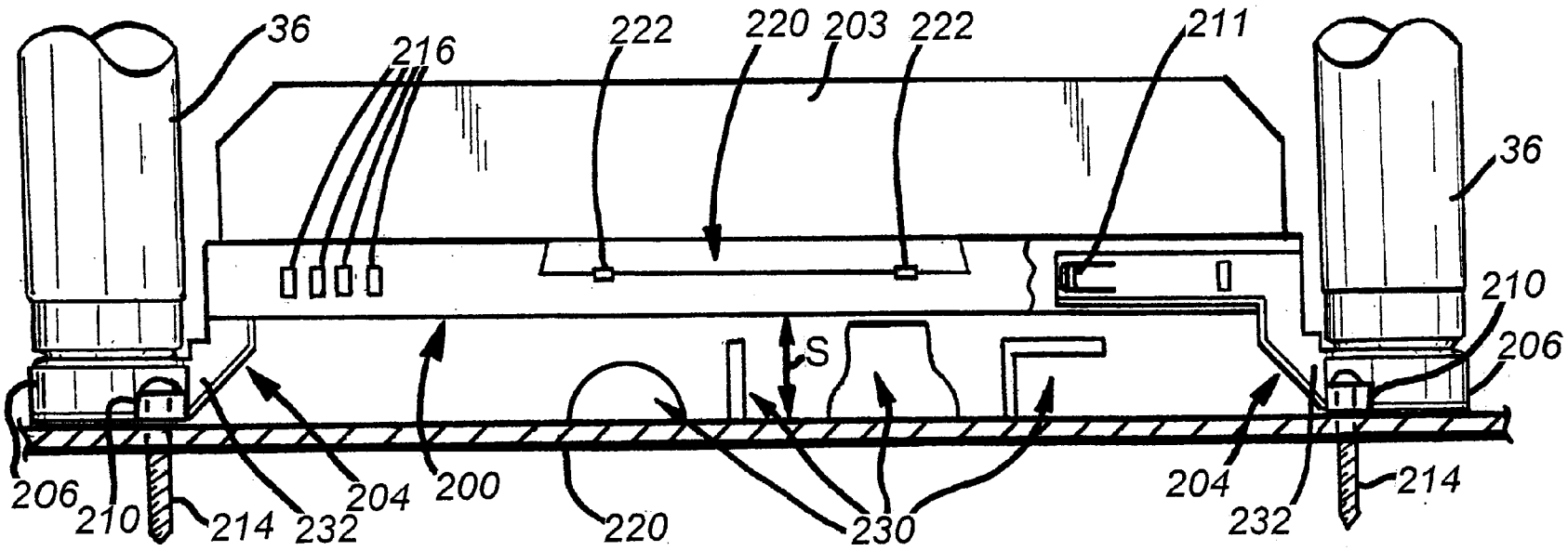
FIG. 7 is a plan view of the bracket and ballast of FIG. 3 detailing attachment thereof to an end wall of a fixture enclosure box.

Rather than a T-shaped slot, the slot on the central bracket section 200 according to FIGS. 5–7 defines an angled dovetail structure 220 according to this embodiment. As noted, any acceptable retaining structure can be used in any of the configurations described herein. Like a T-shaped slot, the dovetail 220 retains the ballast against pull-away from the bracket, and enables quick, slidable connection and disconnection therefrom.

While a friction fit may be sufficient to secure the ballast once it is slide on to the bracket, a pair of moveable spring-loaded shoulders 222 can be used to more firmly secure the ballast with respect to the central bracket section in this and other embodiments described herein. By applying appropriate pressure, or by inserting, a small screw driver/blade to move the shoulders out of interfering engagement with the dovetail structure, the ballast can be slid from a locked engagement with the main bracket section.

The bulb mount/connector ends 206 of this and other embodiments are generally conventional in internal design. This means that they include conventional contacts for electrically connecting the two prongs of a conventional tubular fluorescent light bulb. In addition, their thickness T is chosen so that when they lay against the end wall 220 of a fixture box, on each of opposing ends of that fixture box, they are set at the proper spacing to accommodate a conventional-length fluorescent bulb. Further, the bracket in this and other embodiments is configured so that the main bracket section 200 resides at a Spacing S away from the end wall along most of its length as shown in FIG. 7. This enables the bracket to override any obstructions (230 for example) that may be found along a retrofit fixture box. The spacing S can be between ¼ inch and 1 inch in most embodiments. However, the exact spacing as can be varied upon the nature of obstructions found along a particular fixture box end wall. To enable the spacing S to be maintained, the ends 204 include rearwardly angled sections 232 that enable the mounting ends 206 to lay flushly against the end wall, while the remaining central section 220 is suspended away from the end wall. While non-perpendicular sections 232 are used in this embodiment, any bridging shape is contemplated.

Figure 8:
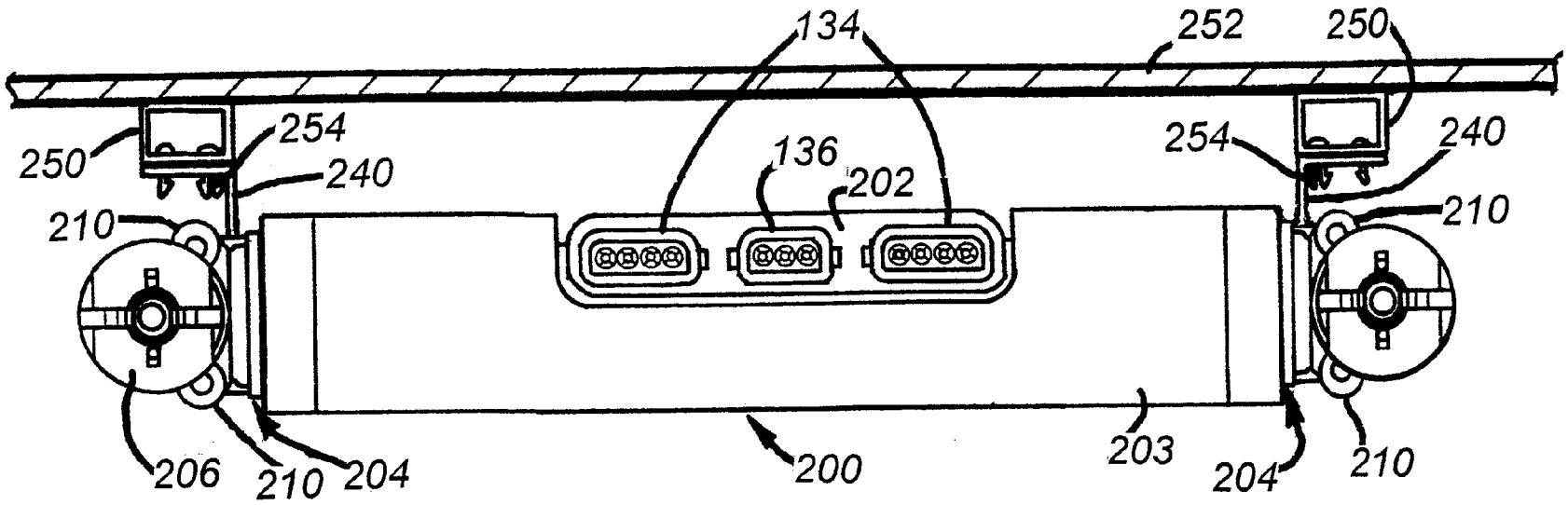
FIG. 8 is a side view of the bracket and ballast of FIG. 8 detailing attachment thereof to a top wall of a fixture enclosure box according to an alternate embodiment.

FIG. 8 details an alternate embodiment based upon the general bracket design shown in FIGS. 5–7. Where end wall-mounting of brackets within the fixture box is undesired or not practical, a secondary mounting bracket 240 can be welded, soldered or clipped in place on either the ends 204 (or on the main bracket section 200). In this embodiment, the secondary brackets 240 are located on the ends 204 to enable them to move toward and away from the central bracket section in conjunction with movement of the ends 204. A pair of mounting feet 250 are used to further space the secondary brackets 240 from the inner top wall 252 of the fixture box. The feet can be welded, screwed, clipped or riveted (or otherwise fastened) in place to the top wall 252. Additional clips 254 enable the secondary brackets 240 to engage the reflector at adjacent secondary bracket bases. In an alternate embodiment, the secondary brackets 240 can be maintained, but the spacer feet 250 can be omitted, allowing the brackets 240 to serve primarily in supporting the reflector (as shown generally in FIG. 2) while the dogs 210 are used for mounting the bracket ends 204 to the box end walls in the manner described in FIG. 7.

Figure 9:
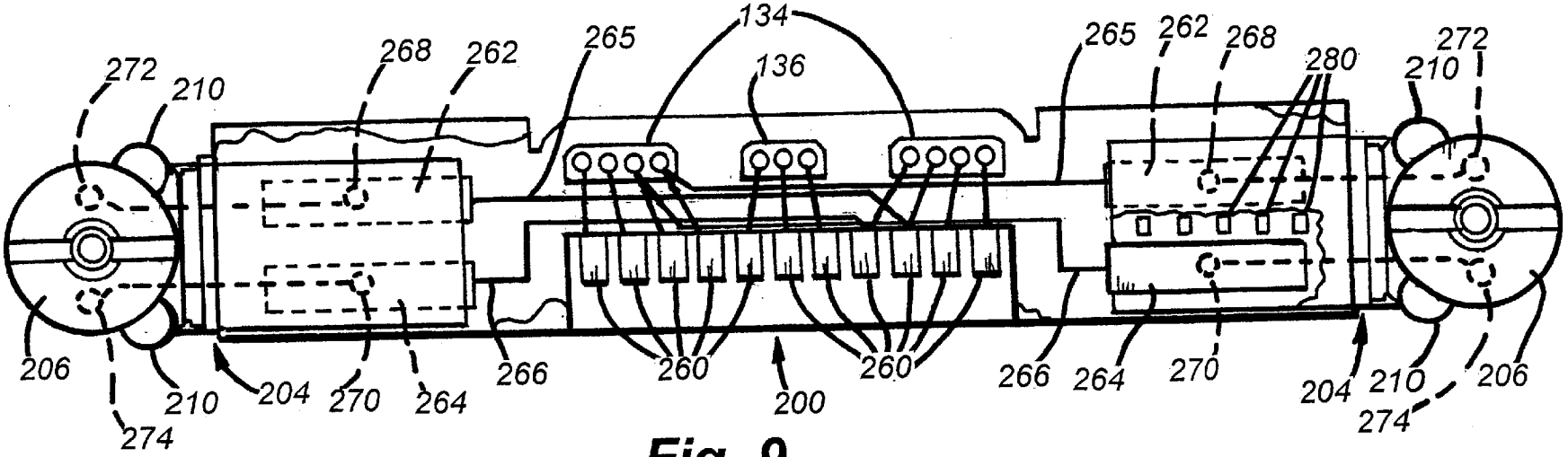
FIG. 9 is an exposed side view of a bracket having movable ends detailing the wiring arrangement thereof.
Figure 10:
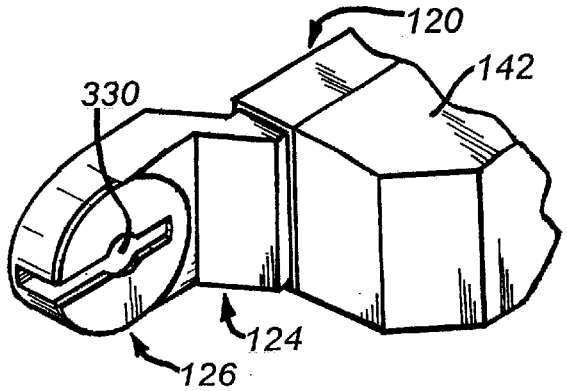
FIGS. 10–13 are partial perspective views showing linear movement of the bracket end according to the embodiment of this invention.
Figure 11:
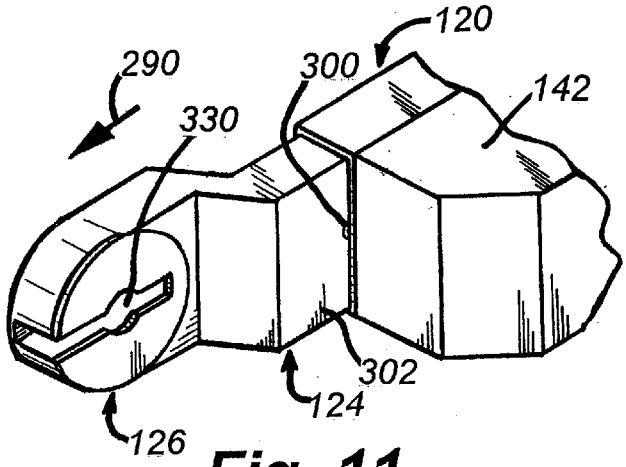
Figure 12:
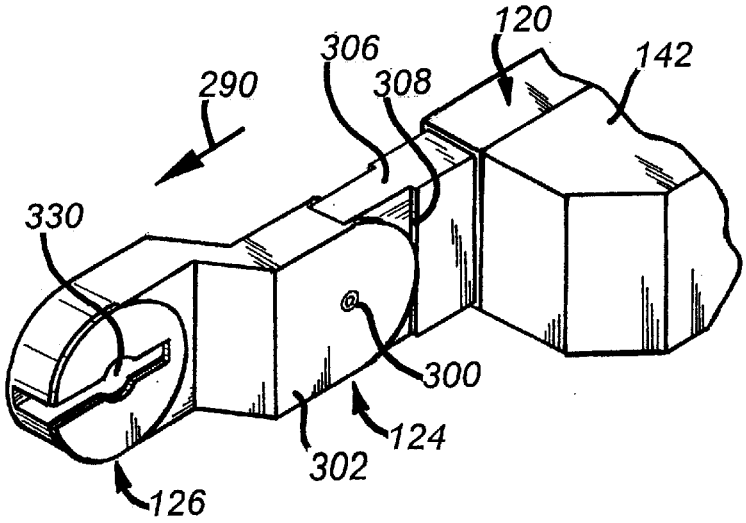
Figure 13:
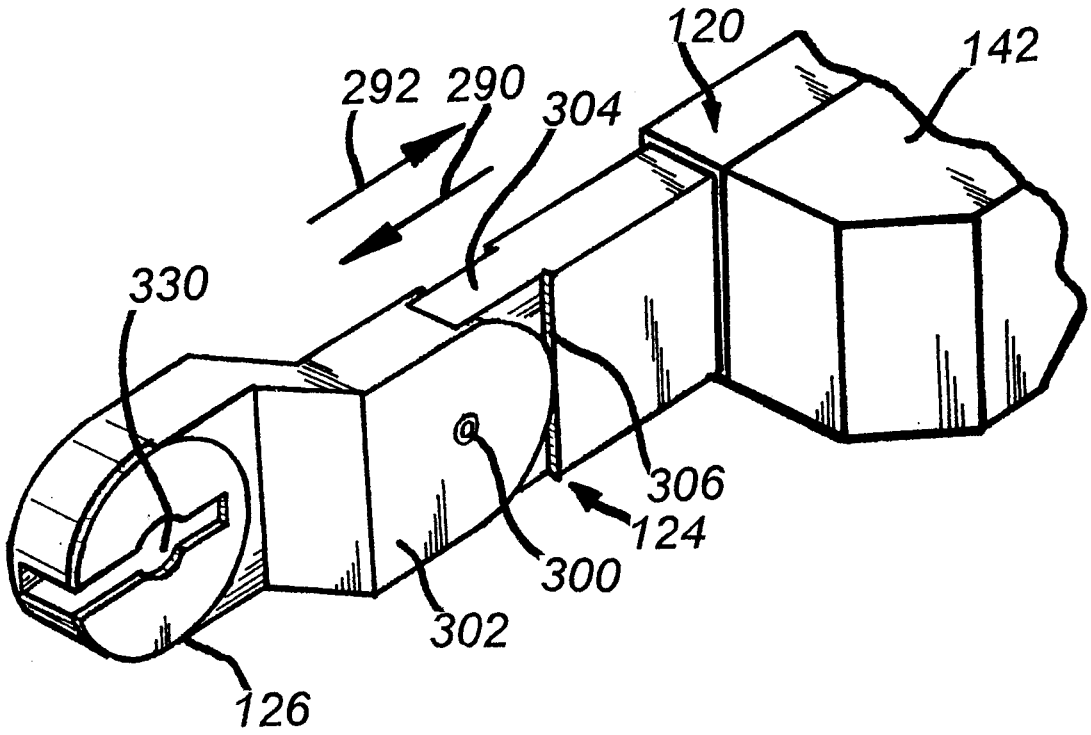

FIG. 9 illustrates in further detail the internal connections for the bracket of FIGS. 5–8. The main section 200 includes a series of contact pads 260 which can be spring-loaded as described above. These contact pads 260 are each internally wired to a respective connector on each of the sockets 134 and 136. In addition, selected of the pads 260 are wired to each of a pair of contact plates 262 and 264 using respective internal wires or leads 265 and 266. The contact pads 260 are in electrical connection with corresponding moving, spring-loaded contacts 268 and 270, respectively. Note that pads, plates and leads described herein can be formed from a variety of conductive metals such as thin brass or copper rated for the currents and voltages encountered in a commercial lighting application. Springed contacts can be biased by separate springs or by internal spring force. The contact plates 262 and 264 are, in turn, wired to fluorescent bulb mounting sockets 272 and 274 respectively. As the bracket ends 204 slide in and out of the central bracket section 200, the spring-loaded contacts 268 and 270 maintain electrical connection with the respective plates 264 and 266. This enables the spacing of the mounting ends 206 to be altered without affecting the electrical connection. Note also that the slide-locking slots 280 are provided along the front face of the main bracket section 200 in this example. As described above, these slots 280 engage corresponding spring-loaded shoulders within each bracket end 204.

Figure 14:
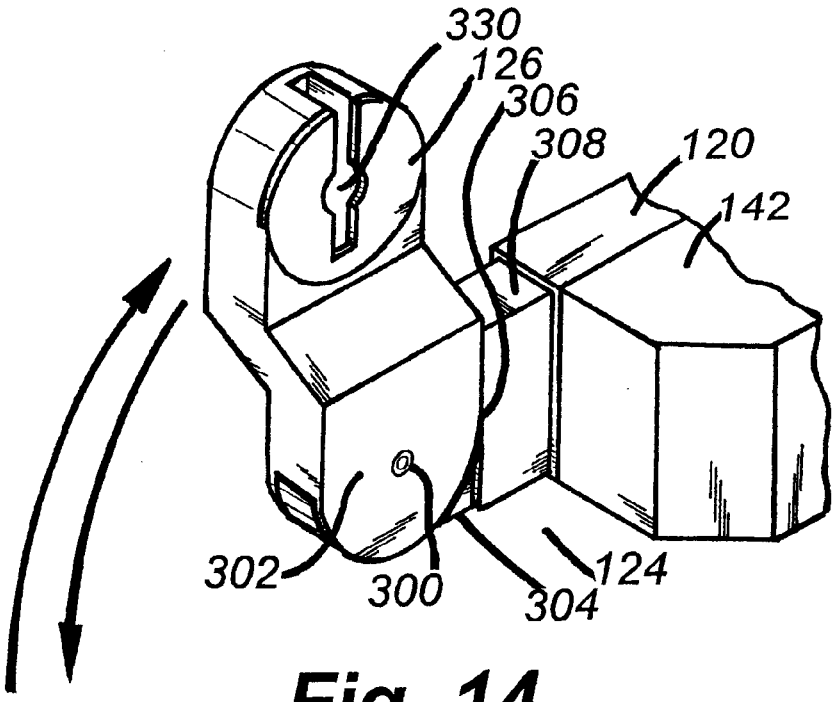
FIGS. 14 and 15 are partial perspective views showing pivotal movement of the bracket end of FIGS. 10–13.
Figure 15:
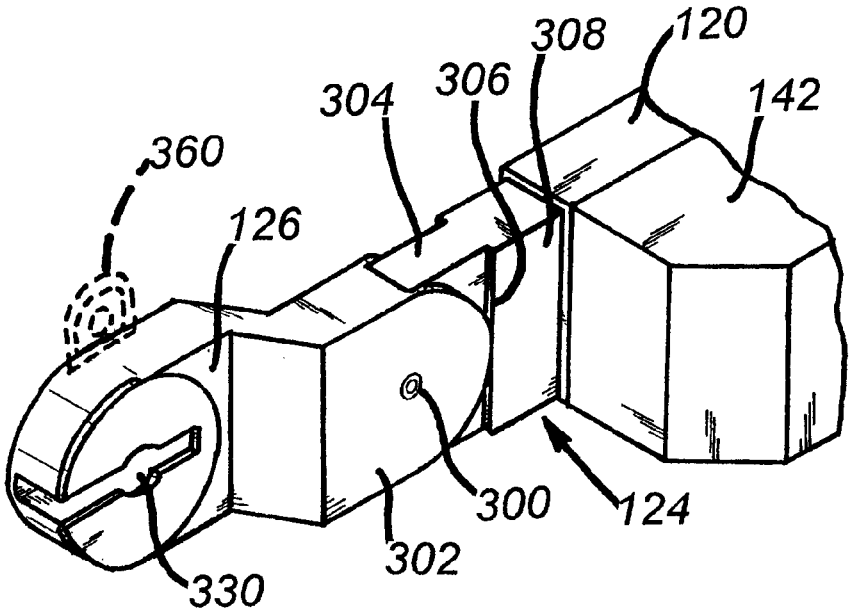

FIGS. 10–13 show more clearly the movement of a bracket end (in this example the end 124 from the embodiment of FIG. 3) with respect to the central bracket section. As can be seen by the arrows 290 and 292 sliding movement can occur. In addition as detailed in FIG. 14 and 15, this embodiment contemplates rotary movement along an arc of approximately 180 degrees. A pivot 300 is provided along the outer pivot section 302 of the mounting and 126. The outer mounting section 302 rides on a narrowed base end 304 a wider shoulder 306 limits rotary movement of the mounting and 126 as the pivot section 302 comes into an engagement with the shoulder 306. At each rotational limit. In general, the segment 302 and the inner slide portion 308 are the same thickness so that the slide segment 302 can be completely retracted into the main bracket 120 without interference. Note that a variety of mounting structures can be applied to the bracket shown generally in FIGS. 3–4 and 10–15. For example, a screw can be applied through the enlarged well 330 in the center of the mounting end 126 whereby the screw passes through to the underlying end wall of the fixture box. Alternatively, top mount brackets or dogs, as described above can be provided to the bracket. One such dog 360 is shown in phantom in FIG. 15 by way of example.

Figure 16:
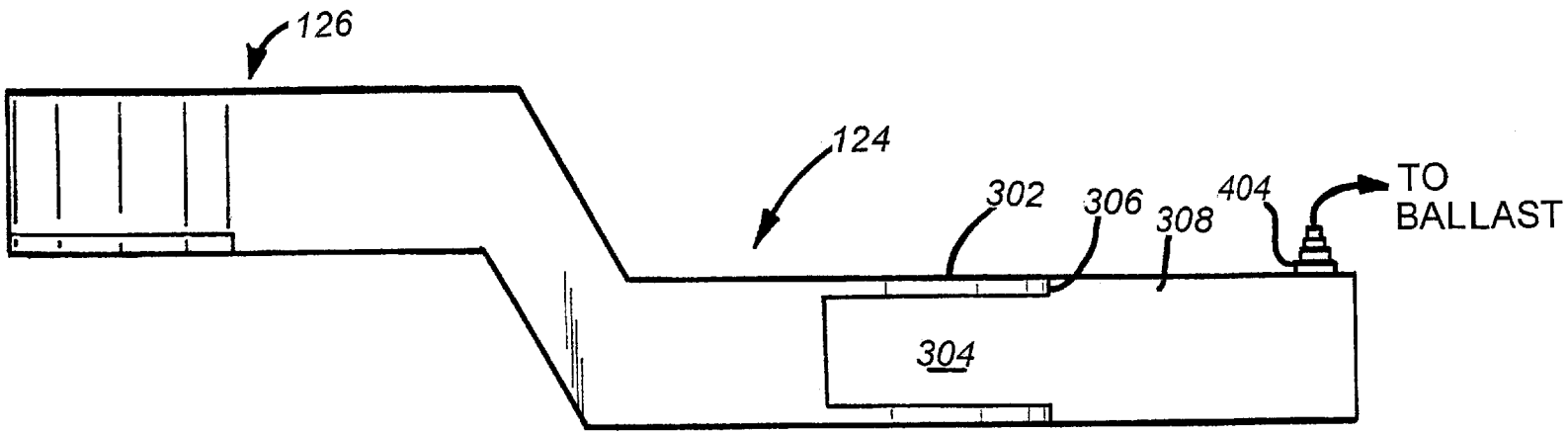
FIG. 16 is a plan view of the bracket end FIGS. 13–15.
Figure 17:
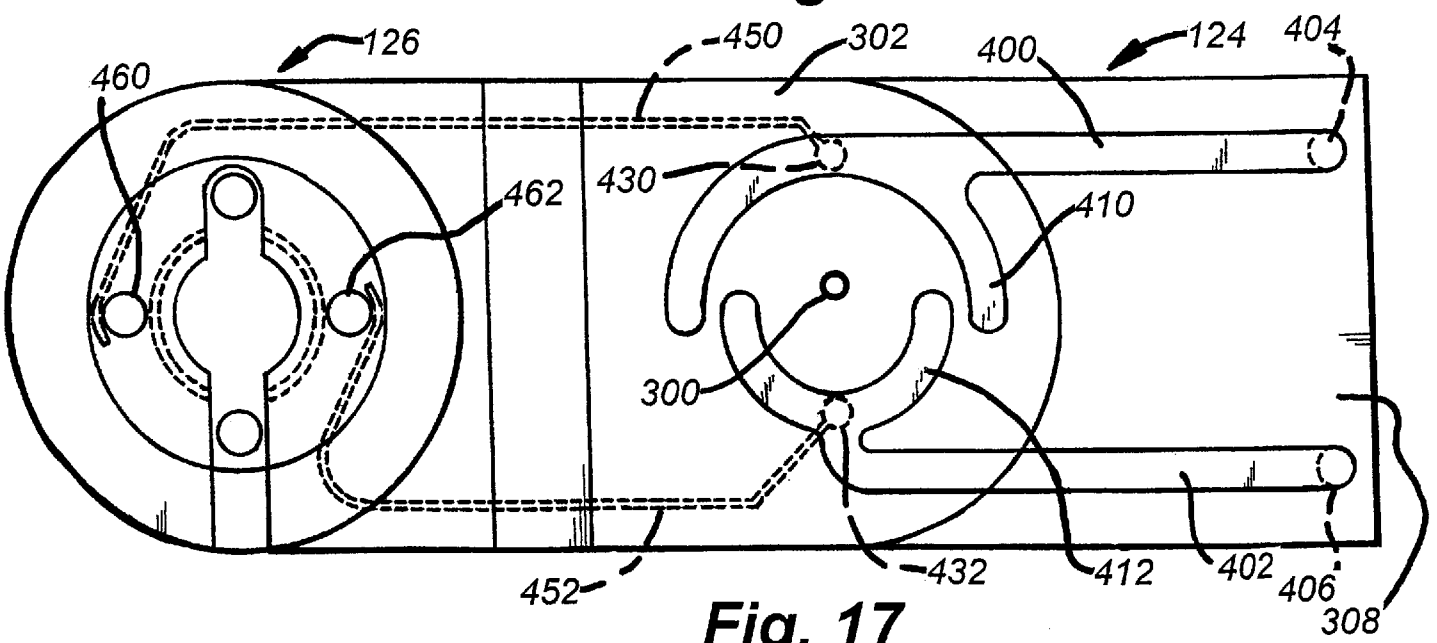
FIG. 17 is an exposed side view of the bracket end of FIGS. 13–15.

In order to enable electrical connection to be maintained given both rotary and sliding movement, FIG. 16 and 17 illustrate a contact pad assembly. The linear contact pads 400 and 402 engage respective contacts 404 and 406 that reside in the main bracket section 120. The main bracket section is omitted for clarity. As the section 308 slides within the main bracket section, the pads 400 and 402 maintain contact with the contacts 404 and 406. The pads 400 and 402 join a pair of semi-circular structures 410 and 412, respectively. The curved structure 410 has a larger diameter, lying outwardly of the opposing curve structure 412. These curve structures electrically connect to an additional pair of contact pads 430 and 432 that are mounted in the pivoting segment 302. As pivoting segment pivots on its pivot 300 about the slide 308, the contacts 430 and 432 ride about their semi-circular pads 410 and 412. The contacts 430 and 432 are, likewise, connected by appropriate leads 450 and 452 to the bulb mounting base contacts 460 and 462.

Figure 18:
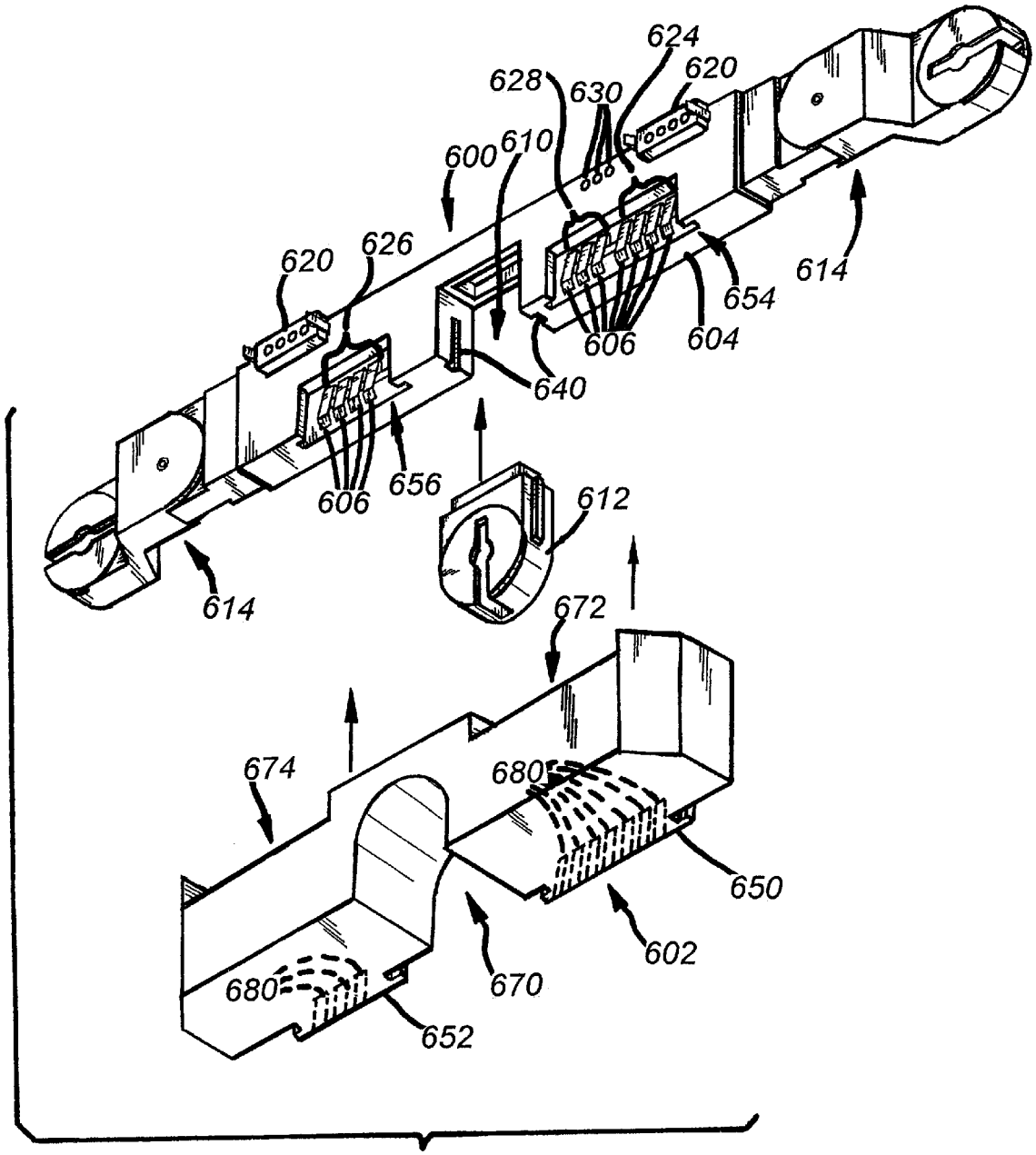
FIG. 18 is an exploded perspective view of a bracket and ballast for mounting three bulbs therein according to an alternate embodiment of this invention.

FIG. 18 details an alternate embodiment for a bracket 600 and ballast housing assembly 602 according to another embodiment of this invention. This bracket is adapted to enable mounting of three bulbs therein. The bracket includes a main bracket section 604. Having contact pads 606 like those described above. The contact pad 606 are divided into two clusters, each on opposing sides of a slot 610 for receiving an optional third bulb mounting base 612. The outer bulb-mounting/connecting ends 614 pivot and slide in a manner described above with reference to FIGS. 10–17. A pair of ballast driving current outlet sockets each with four connecting pins are also provided. These operate as described above similarly, both the outer mounting ends 614 and the removable central mounting/connecting base 612 are provided with driving current from the ballast pads 606. In particular the pair of four-pad clusters 624 and 626 provide driving current while the three-pad cluster 628 is connected with AC power feeds 630. Appropriate plug connections can be provided within the slots 640 of the central base socket. The ballast includes a pair of T-shaped connectors 650 and 652 for engaging associated T-shaped slots 654 and 656 in the central bracket section. A well 670 is also defined in the ballast to provide clearance for a central tubular fluorescent bulb mounted within the mount/connector 612. Likewise a pair of lower wells 672 and 674 are provided in the ballast for the sockets 620. Contact pads 680 are provided adjacent each T-shaped connector 650 and 652 on the ballast. These are connected to appropriate ballast fluorescent bulb-driving circuitry (not shown). The circuitry is similar to that described above. In order to fit the circuitry into the modified ballast housing it may be desirable to divide it into smaller-components.

Figure 19:
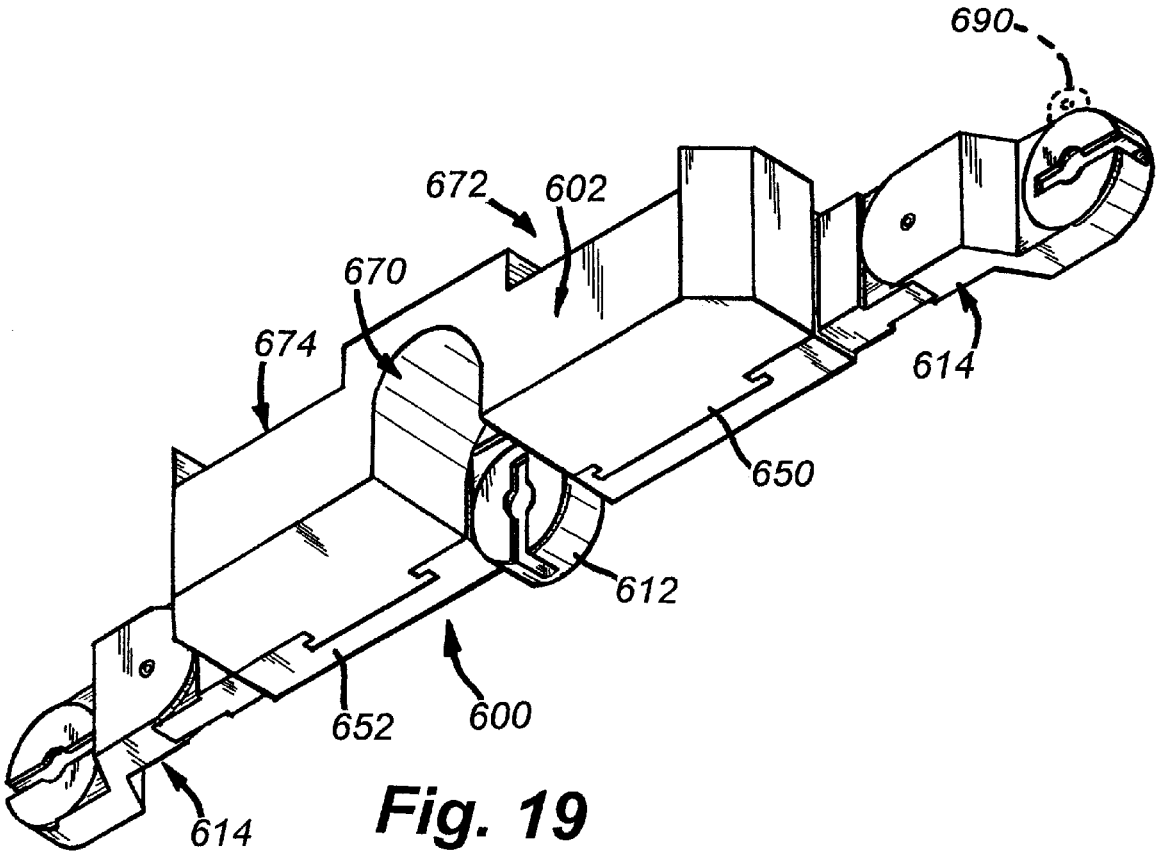
FIG. 19 is a perspective view of the assembled bracket and ballast of FIG. 19.

FIG. 19 shows the ballast and bracket in assembled form with the central bulb mounting/connecting base 612 installed. A similar three-bulb bracket, with or without ballast mounting pads and slots, can be provided to the opposing side of the fixture. As in the other brackets described herein, various mounting assemblies can be utilized to secure the bracket and the ballast to a fixture box. Appropriate connectors can be provided to electrically tie the opposing bracket to the ballast-carrying bracket. An exemplary dog 690 is shown. Multiple dogs can be provided to the bracket ends for securing each bracket end 614 in position against and end wall of the fixture box. Top wall mounting is also contemplated, as well as other box mounting techniques. A reflector for use with such a three-bulb bracket can be provided. It would typically include three wells centered over each. The geometry can be the same as that described above, and in the '554 patent application.

Figure 20:
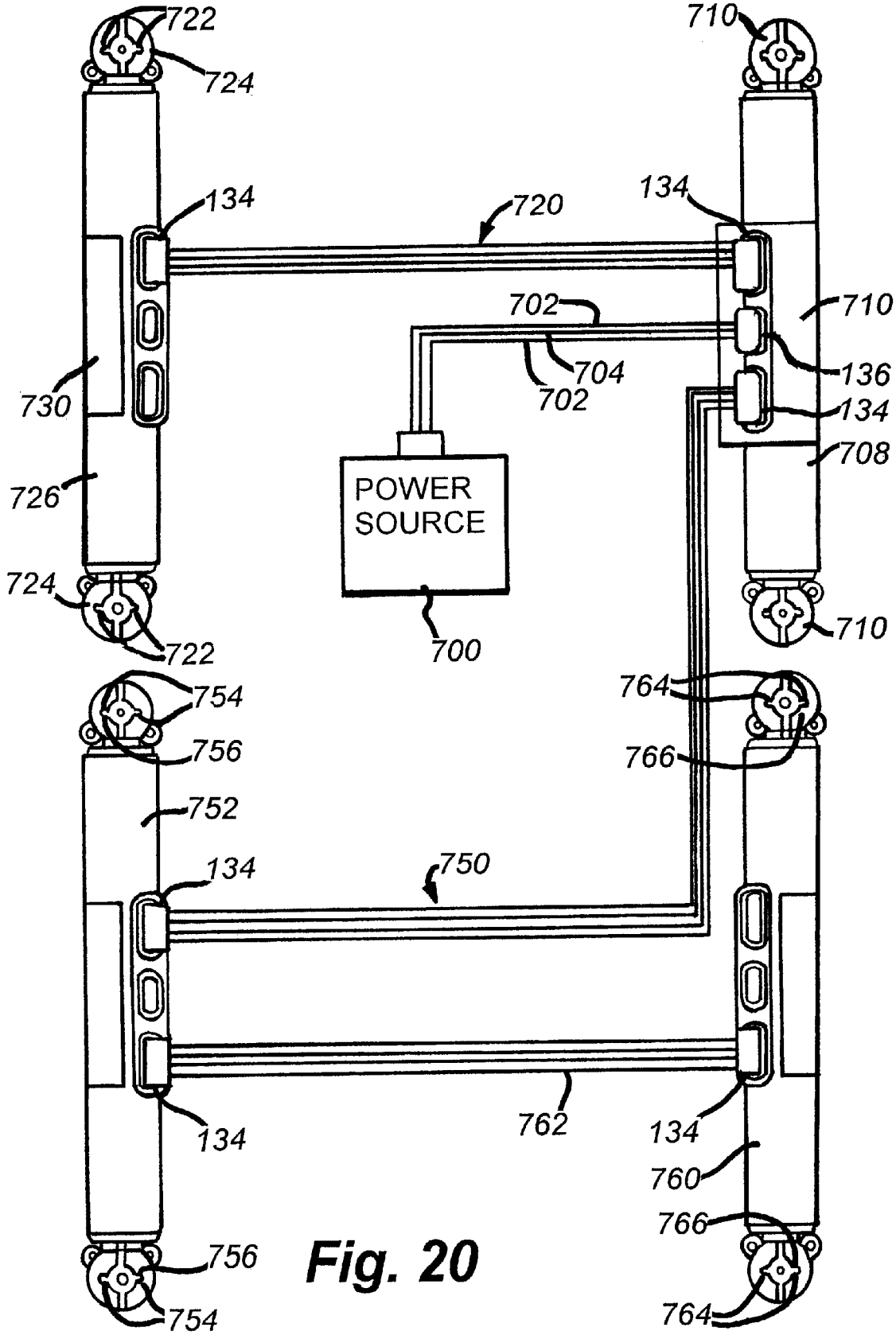
FIG. 20 is a schematic diagram showing the powering of two sets of fixture brackets using a single ballast according to this invention.

Finally, with reference to FIG. 20, an exemplary wiring arrangement for connecting the brackets of a single fixture, and for also ganging two fixtures together on a single ballast, is shown. A power source (typically raw 120 VAC/60 Hz current) 700 is provided on two main feed wires 702 and a ground 704 to one of the brackets 708 at its central socket 136. The ballast 710 receives the AC current and converts it to high-frequency fluorescent bulb driving fixture according to conventional techniques. This current is delivered to the sockets 134 and also internally to the bulb mounting bases 710. Four remote wires 720 tie driving current to each of four pin sockets 722 on the mounting base 724 of the opposing bracket 726. Note that this bracket (726) can include a standard mounting slot 730 for receiving a ballast, but does not include another ballast thereon since the ballast 710 is driving the entire assembly. A socket 134 in the bracket 726 is used to receive the driving current from the wire 720. Similarly, another socket 134 on the main ballast-carrying 708 directs high frequency driving current over remote wires 750 to a bracket 752. A socket 134 in bracket 752 again receives the current from wire 750. This current is distributed to each of the bulb mounts/connectors 754 on respective ends 756 of the bracket. Again, another socket connector 134 outputs driving current to the fixture's opposing bracket 760 through four wires 762. This, again, occurs via an opposing socket 134. The driving current is delivered to the bulb mounts/connectors 764 on bracket ends 766. A variety of internal and external wiring arrangements are expressly contemplated and will be clear to those of ordinary skill. The number of fixtures ganged according to this technique is highly variable and is often limited only by the driving current limitations of the wiring and ballast.

The foregoing has been a detailed description of various embodiments of the invention. Certain modifications and additions can be made without departing from the spirit and scope of the invention. For example, while a recessed housing is shown, the techniques shown herein can be applied to flush-mount housings. The number of bulbs within a certain housing is highly variable as is the number of fixtures ganged together using one ballast. The locking mechanisms used to secure ballasts to brackets and brackets to boxes can be varied widely. Locking structures can be used for permanent or semi-permanent securment can be accomplished using fasteners, rivets or screws. Furthermore, while both bracket ends are shown as movable according to the above-described embodiments, it is expressly contemplated that neither or only one of the opposing bracket ends can be movable according an alternate embodiment. Additionally, while contact plates are shown for maintaining connection between movable bracket components herein, it is contemplated that internal or external flexible wires can be substituted. Finally, while two or three bracket bulb mounts/connectors are provided in the above-described embodiments, more or fewer mounts/connectors can be provided to a particular bracket and ballast assembly according to this invention. Accordingly, this description is meant to be taken only by way of example and not to otherwise limit the scope of the invention.

What is claimed is:

1. A bracket assembly for a fluorescent lighting fixture having a fixture enclosure box defining a bottom opening for transmitting light therethrough comprising:

first main bracket section;

a first pair of spaced-apart fluorescent bulb-mounting/connecting ends located on each of opposing ends of the first main bracket section;

a second main bracket section;

a second pair of fluorescent bulb-mounting/connecting ends located on each of opposing ends of the second main bracket section wherein the first main bracket section and the second main bracket section are spaced apart from each other with the first pair of fluorescent bulb-mounting/connecting ends and the second pair of fluorescent bulb-mounting/connecting ends aligned so as to mount a respective pair of fluorescent bulbs therebetween a ballast mounting bracket located on the first main bracket section between each of the first pair of fluorescent bulb-mounting/connecting ends, the ballast mounting bracket including a plurality of bracket contact pads, a first group of the plurality of bracket contact pads being electrically connected to each of the first pair of fluorescent bulb mounting/connecting ends and the second pair of fluorescent bulb mounting/connecting ends a second group of the plurality of fluorescent bulb mounting/connecting ends being electrically connected to an electric power source; and a removable ballast assembly having a plurality of ballast contact pads, the ballast being constructed and arranged to removably mate with the ballast mounting bracket wherein each of the plurality of ballast contact pads are located in predetermined electrical contact with each of the plurality of bracket contact pads.

2. The bracket assembly as set forth in claim 1 wherein each of the ballast and the ballast mounting bracket are constructed and arranged to enable the ballast assembly to be brought into slidable engagement with and disengagement from the first main bracket section.

3. The bracket assembly as set forth in claim 2 wherein the first pair of bulb-mounting/connecting ends and the second pair of bulb-mounting/connecting ends each include a mounting dog thereon constructed and arranged to receive a fastener that secures the dog to an end wall of the fixture enclosure box.

4. The bracket assembly as set forth in claim 3 wherein the first pair of bulb-mounting/connecting ends and the second pair of bulb-mounting/connecting ends are each located on bridging sections that space the main bracket section remote from the end wall.

5. The bracket assembly as set forth in claim 1 wherein the first pair of bulb-mounting/connecting ends and the second pair of bulb-mounting/connecting ends are each slidably mounted relative to the first main bracket section and the second main bracket section, respectively.

6. The bracket assembly as set forth in claim 5 wherein the first pair of bulb-mounting/connecting ends and the second pair of bulb mounting/connecting ends each include a respective slide section in slidable engagement with the first main bracket section and the second main bracket section, respectively, and a respective pivot section extending outwardly from the first main bracket section and the second main bracket section respectively and each pivot section being pivotally mounted to the respective slide section.

7. The bracket section as set forth in claim 1 wherein the first pair of bulb-mounting/connecting ends and the second pair of bulb-mounting/connecting ends are each in pivotal engagement with respect to the main bracket section.

8. The bracket section as set forth in claim 4 wherein each of the first pair of bulb-mounting/connecting ends and the second pair of bulb-mounting/connecting ends each include, extending upwardly therefrom, a secondary bracket interconnecting to a portion of a flexible reflector having a reflector well that is approximately centered, respectively, over each of the first pair of bulb-mounting/connecting ends and the second pair of bulb-mounting/connecting ends, wherein slidable movement of each of the first pair of bulb-mounting/connecting ends and the second pair of bulb-mounting/connecting ends causes corresponding flexible movement of the reflector well.

9. A method for attaching a bracket assembly for mounting and electrically connecting a pair of fluorescent bulbs to a ceiling-mounted fixture box, the box having a bottom opening, comprising the steps of:

locating a first bracket adjacent to a first end wall of the fixture box through the bottom opening and fixedly attaching the first bracket to the fixture box;

locating a second bracket adjacent to a second end wall of the fixture box opposite the first end wall and fixedly attaching the second bracket to the fixture box;

electrically connecting the first bracket to a line power source, and attaching a removable ballast housing to the first bracket;

electrically connecting the second bracket to the first bracket including electrically connecting the second bracket to a high-frequency power output of the ballast housing;

providing a bulb reflector that directs reflected light from each of the two bulbs mounted in the brackets outwardly from the opening in a predetermined reflection pattern; and wherein the step of locating the first bracket and the step of locating the second bracket both include slidably moving mounting/connecting ends that each carry respective ones of the bulbs to a predetermined spacing with respect to each other.

10. The method as set forth in claim 9 further comprising providing secondary brackets for interconnecting each of the mounting/connecting ends to the reflector, and wherein the step of moving includes flexing the reflector to follow a slidable movement of each of the mounting/connecting ends and interconnecting the reflector at an adjacent location to each of the mounting/connecting ends with the secondary brackets.

11. The method as set forth in claim 9 wherein the step of locating includes pivotally moving the mounting/connecting ends with respect to a central portion of each of the first bracket and the second bracket.

12. A method for attaching a bracket assembly for mounting and electrically connecting a pair of fluorescent bulbs to a ceiling-mounted fixture box, the box having a bottom opening, comprising the steps of:

locating a first bracket adjacent to a first end wall of the fixture box through the bottom opening and fixedly attaching the first bracket to the fixture box;

locating a second bracket adjacent to a second end wall of the fixture box opposite the first end wall and fixedly attaching the second bracket to the fixture box;

electrically connecting the first bracket to a line power source, and attaching a removable ballast housing to the first bracket;

electrically connecting the second bracket to the first bracket including electrically connecting the second bracket to a high-frequency power output of the ballast housing;

providing a bulb reflector that directs reflected light from each of the two bulbs mounted in the brackets outwardly from the opening in a predetermined reflection pattern; and wherein the step of fixedly attaching each of the first bracket and the second bracket includes fastening each of opposing bulb-connecting/mounting ends for carrying each of the bulbs to the first end wall and the second end wall, respectively.

13. The method as set forth in claim 12 wherein the step of fixedly attaching further includes bridging a portion of the first and the second end wall with a respective first and second bracket between the respective connecting/mounting ends thereon whereby clearance for structures located on the first end wall and the second end wall thereat is provided.

* * * * *